US006631819B1

(12) United States Patent
Diak/Ghanem

(10) Patent No.: US 6,631,819 B1
(45) Date of Patent: Oct. 14, 2003

(54) INSULATED AND LUMINESCENT NURSING BOTTLE

(75) Inventor: Darlene Diak/Ghanem, Deerfield Beach, FL (US)

(73) Assignee: Worry Free Inventions, Inc., Deerfield Beach, FL (US)

( * ) Notice: Subject to any disclaimer, the term of this patent is extended or adjusted under 35 U.S.C. 154(b) by 25 days.

(21) Appl. No.: 10/210,755

(22) Filed: Jul. 31, 2002

(51) Int. Cl.[7] ..... A61J 9/00

(52) U.S. Cl. ..... 215/11.1; 215/11.6; 215/13.1; 362/34; 362/101

(58) Field of Search ..... 215/11.1, 11.3, 215/11.6, 13.1; 220/592.17, 592.27; D7/608; 362/34, 101

(56) References Cited

U.S. PATENT DOCUMENTS

| | | | | | |
|---|---|---|---|---|---|
| 416,355 | A | * | 12/1889 | Chalk | 215/11.1 |
| 514,575 | A | * | 2/1894 | Turner | 215/11.1 |
| 1,032,610 | A | * | 7/1912 | Kern | 362/101 |
| 1,221,335 | A | * | 4/1917 | Kline | 215/11.1 |
| 1,523,152 | A | * | 1/1925 | Wolfe | 215/11.1 |
| 2,096,961 | A | * | 10/1937 | Condon | 215/11.1 |
| 3,145,867 | A | * | 8/1964 | Roberts et al. | 215/11.1 |
| 3,661,288 | A | * | 5/1972 | Noll | 215/11.1 |
| 4,676,387 | A | * | 6/1987 | Stephenson et al. | 215/11.1 |
| 4,759,453 | A | * | 7/1988 | Paetzold | 215/11.6 X |
| 4,813,556 | A | * | 3/1989 | Lawrence | 215/11.1 X |
| 4,832,213 | A | * | 5/1989 | Sharon et al. | 215/11.1 |
| 4,971,211 | A | * | 11/1990 | Lake | 215/11.1 X |
| 5,044,509 | A | * | 9/1991 | Petrosky et al. | 215/11.1 X |
| 5,069,351 | A | * | 12/1991 | Gunderson et al. | 215/11.1 |
| 5,094,363 | A | * | 3/1992 | Monahan et al. | 215/13.1 X |
| 5,180,071 | A | * | 1/1993 | Crosson | 215/11.1 |
| 5,447,248 | A | * | 9/1995 | Rodriguez et al. | 215/13.1 X |
| 6,164,469 | A | * | 12/2000 | Sartore | 215/13.1 X |
| D454,282 | S | * | 3/2002 | Mano | D7/608 |
| 6,474,467 | B1 | * | 11/2002 | Kurdian | 220/592.28 X |

* cited by examiner

*Primary Examiner*—Sue A. Weaver
(74) *Attorney, Agent, or Firm*—Robert M. Downey, P.A.

(57) ABSTRACT

A baby bottle has a main body with an upper portion and a lower portion, and a neck provided with threads for removably attaching a standard nipple and collar thereto. An insulated structure of the main body includes an inner wall, an outer wall, and an air space between the walls for maintaining the liquid contents hotter or cooler for extended periods of time, while also preventing the formation of condensation on the outside of the bottle. Luminescent elements, such as shapes, letters or numbers, are applied to the outer surface of the inner wall to enhance visibility of the bottle and the level of the liquid contents in dark or low light conditions. In an alternative embodiment, the luminescent material is incorporated into the composition of the wall structure during the molding process. The lower portion of the main body is shaped for easy grasping by infants and toddlers. The upper portion is angled relative to the lower portion, creating a smooth curve from the bottom to the neck to promote fluid flow to the nipple while lying down or sitting upright, thereby reducing ingestion of air while nursing.

15 Claims, 1 Drawing Sheet

INSULATED AND LUMINESCENT NURSING BOTTLE

BACKGROUND OF THE INVENTION

1. Field of the Invention

This invention relates to nursing bottles for infants and toddlers and, more particularly, to an insulated and luminescent nursing bottle which is shaped to include an angled top portion and an hourglass configuration for ease of grasping by the infant or toddler.

2. Discussion of the Related Art

Nursing bottles, more commonly referred to as baby bottles, have been known for many years. Since the introduction of the first nursing bottle, others have proposed numerous modifications to the original design in an attempt to improve appearance and function. The traditional nursing bottle design has a generally cylindrical body which tapers into a neck at an open top of the vessel. The neck is provided with threads about its exterior for removably attaching a collar and nipple to the top of the bottle. The size of the threaded neck on the conventional nursing bottle has become a universal standard in the industry. In fact, most contemporary bottle designs incorporate this standard neck and thread size in order to remain compatible with conventional nipple collars.

Most improvements to the original nursing bottle have been directed towards making it easier for infants to grasp the bottle and reducing the amount of air ingested by infants while nursing. For instance, some bottle designs provide multiple flat surfaces about the sides, while others have proposed indentations or reduced diameters areas to promote ease of grasping. In order to reduce air intake, some bottles provide an angled design, wherein an upper part of the bottle is disposed at an angle relative to the lower part of the bottle. An example of this type of nursing bottle design is seen in the Stephenson et al., U.S. Pat. No. 4,676,387. In order to maintain the liquid contents, usually baby formula or milk, cooler or hotter for extended periods of time, others have proposed an insulated structure. In particular, U.S. Pat. No. 5,156,284 discloses a thermally insulated baby bottle having an outer wall, an inner wall, and a foam insulative material between the walls.

One common problem which seems to have been overlooked in the related art is the inability to see the nursing bottle and level of the liquid contents therein when in a poorly lit or dark environment. For instance, many parents find themselves fumbling in the dark in search of a lost bottle when awakened in the middle of the night by their crying infant. And, once the bottle is located, it is difficult to determine how much formula or milk remains in the bottle without turning on the light in the child's room.

Notwithstanding the foregoing developments in the related art, there still remains a need for an improved baby bottle which includes an insulated wall structure and which is further structured and disposed to promote ease of grasping by infants and toddlers, while also promoting fluid flow to the nipple when the child is either lying down or sitting upright. Further, there remains a need for a nursing bottle which glows in poorly lit or dark conditions so that the bottle and the level of the liquid contents can be seen without having to turn on the room lights.

OBJECTS AND ADVANTAGES OF THE INVENTION

With the foregoing in mind, it is a primary object of the present invention to provide an improved nursing bottle which is both insulated and luminescent in a dim light or dark environment.

It is a further object of the present invention to provide an insulated and luminescent nursing bottle which incorporates a double-wall structure including an inner wall, an outer wall and an air space between the walls.

It is still a further object of the present invention to provide an improved nursing bottle which includes an insulated double-wall design, including an inner wall and an outer wall, and further wherein the wall structure of the bottle is provided with luminescent means for enhancing visibility of the bottle and the liquid contents therein in dark or low light conditions.

It is still a further object of the present invention to provide an improved nursing bottle which is insulated an luminescent, and further wherein the bottle includes a bottom portion and an angled top portion to promote fluid flow to the nipple while lying down or sitting upright, thereby reducing ingestion of air by an infant while nursing from the bottle.

It is still a further object of the present invention to provide an insulated and luminescent nursing bottle which includes a midsection of reduced dimensions in order to provide for ease of grasping of the bottle by an infant or toddler.

It is still a further object of the present invention to provide an insulated and luminescent nursing bottle which includes a generally hourglass configuration for ease of grasping by an infant or toddler.

These and other objects and advantages of the present invention are more readily apparent with reference to the detailed description and drawings.

SUMMARY OF THE INVENTION

The present invention is directed to a baby bottle having a main body with an upper portion and a lower portion, and a neck having threads for removably attaching a standard nipple and collar to the open top end of the bottle. The main body has an insulated structure including an inner wall defining a liner for holding the liquid contents, and an outer wall spaced from the inner wall. The air space created between the inner and outer walls provides an insulative barrier for maintaining the temperature of the liquid contents either warmer or cooler for extended periods of time. The double-wall construction also prevents formation of condensation on the outer wall.

To enhance visibility of the bottle and the level of the liquid contents therein, a luminescent material is applied to the wall structure. In one embodiment, decorative elements formed of a luminescent material are applied to the outer surface of the inner wall, within the air space between the walls. The decorative elements, such as shapes, letters or numbers, are formed of a luminescent vinyl material or other luminescent material which is safe to place in a dishwasher or microwave oven. Both the outer wall and inner wall are formed of a transparent plastic composition, such as a poly carbon, so that the luminescent decorative elements and liquid contents of the bottle are easily visible through the walls of the bottle. In an alternative embodiment, the luminescent material is incorporated into the composition of the wall structure during the molding process. In this embodiment, the inner wall may be partially or fully formed with a luminescent material, while the outer wall is formed of a transparent plastic material. Alternatively, the inner wall and/or outer wall may be partially formed with luminescent material, so that both the inner wall and liquid contents are visible from the bottle's exterior.

In order to allow for easy grasping of the bottle by infants and toddlers, the lower portion of the main body is shaped to include an area of reduced dimension. More particularly, the lower portion is preferably provided with an hourglass configuration which tapers inwardly at the mid-section. The upper portion is angled relative to the lower portion, creating a smooth curve from the bottom of the bottle to the neck, thereby promoting fluid flow to the nipple. This angled design, combined with the smooth curve extending from the lower portion through the top portion, directs the liquid contents to the upper portion and attached nipple while the feeding infant is lying down or sitting upright, thereby reducing air flow through the nipple and the resulting discomfort caused by ingestion of air while feeding.

BRIEF DESCRIPTION OF THE DRAWINGS

For a fuller understanding of the nature of the present invention, reference should be made to the following detailed description taken in conjunction with the accompanying drawings in which.

Like reference numerals refer to like parts throughout the several views of the drawings.

DETAILED DESCRIPTION OF THE PREFERRED EMBODIMENTS

Figure 1:
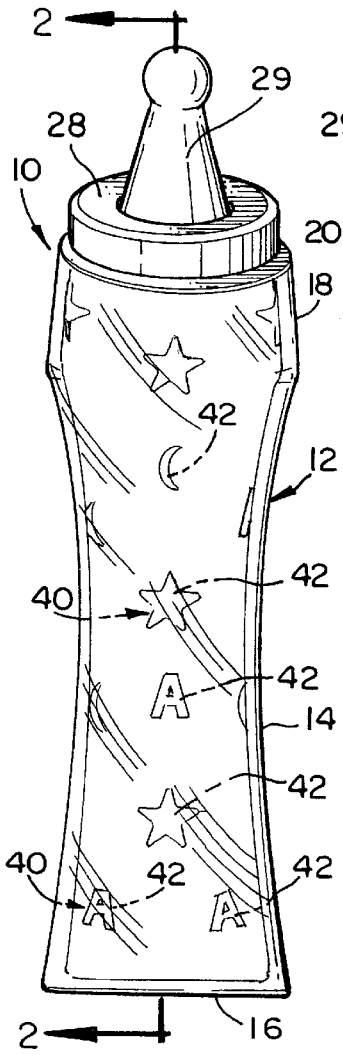
FIG. 1 is a front perspective view of the insulated and luminescent nursing bottle of the present invention.

Referring to the several views of the drawings, the nursing bottle of the present invention is shown and is generally indicated as 10. The nursing bottle 10 is defined by a main body 12 having a lower portion 14 with a bottom end 16 and an upper portion 18. The upper portion 18 is integral with a neck 20 which surrounds an open top 22 of the bottle 10 communicating with a hollow interior 23. The outer annular surface 24 of the neck 20 includes threads 26 for threaded, attached engagement with an inner threaded surface of a collar 28 fixed to a nipple 29. In a preferred embodiment, the outer circumference of the neck 20 and the size and pitch of the threads 26 are specifically structured for compatible engagement with a conventional nipple collar 28 of standard size. Moreover, it is clearly seen in the drawings that the outer circumference of the annular surface 24 of the neck 20 is less than the outer peripheral dimension of the upper portion 18, so that the neck 20 is of reduced size relative to the outer dimension of the upper portion 18.

The main body 12, including the lower portion 14 and upper portion 18, is provided with an insulated wall structure for maintaining the liquid contents in the nursing bottle either warm or cold for extended periods of time. Specifically, the insulated wall structure of the main body includes an outer wall 30 and an inner wall 32. An air space or void 34 is maintained between the outer wall 30 and inner wall 32, providing an insulative barrier between the walls. The double-wall construction with the insulative barrier 34 serves to isolate the liquid contents from the exterior ambient air temperature, thereby slowing the rate of heat transfer between the liquid contents and the outside air temperature surrounding the bottle. This serves to keep the temperature of the liquid contents either cold or warm for a longer period of time as compared to a single wall non-insulated vessel. The barrier created by the air space or void 34 further prevents the formation of condensation on the exterior surfaces of both the inner wall 32 and outer wall 30.

Figure 2:
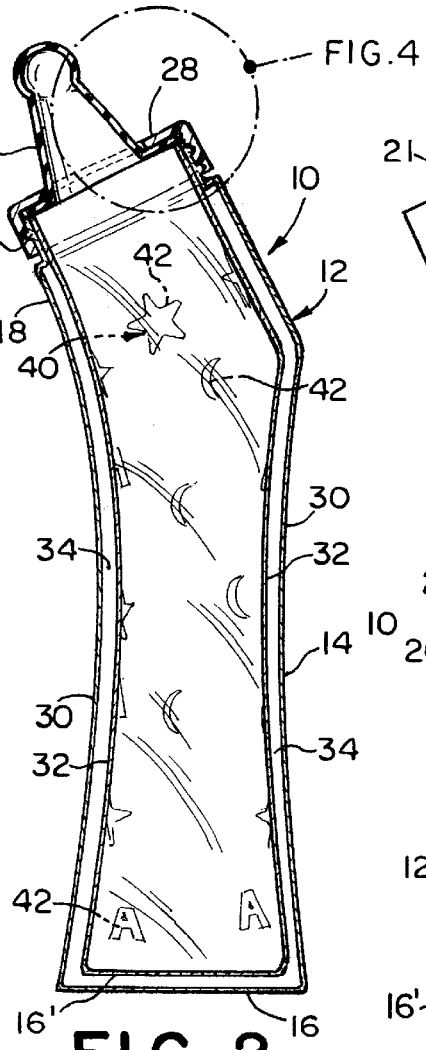
FIG. 2 is a side elevation, in cross-section, taken along the plane of the line 2—2 in FIG. 1.
Figure 3:
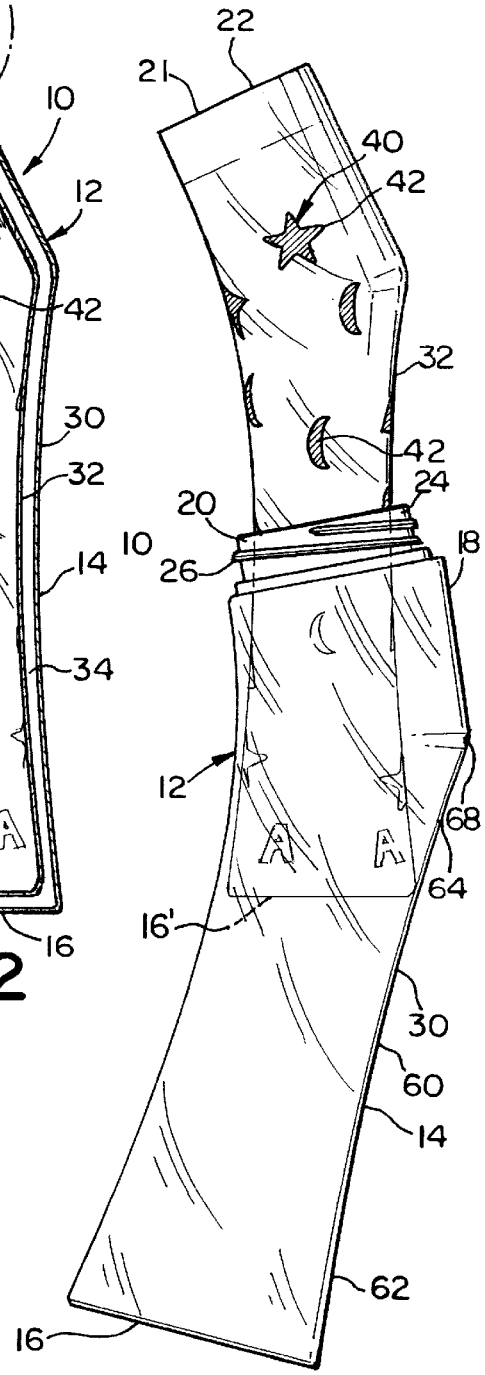
FIG. 3 is an exploded side elevational view showing the inner liner wall partially inserted within the outer shell of the bottle during manufacture thereof.

As seen in FIGS. 1–3, the wall structure of the main body 12 is provided with luminescent means 40 for illuminating the nursing bottle 10 in a dark or dim light atmosphere. Specifically, the luminescent means 40 is structured to hold a charge of light which is released over a period of time, preferably up to eight hours after full charging. The illuminating character of the luminescent means 40, often referred to as glow-in-the-dark, provides a novel and ornamental appearance which is attractive and amusing to infants and toddlers. Further, the illuminating characteristics of the luminescent means 40 serves to enhance the visibility of the nursing bottle 10 and the level of the liquid contents contained therein when in poorly lit or dark conditions. In one embodiment, the luminescent means 40 is defined by a plurality of decorative elements 42, such as attractive shapes, letters or numbers, formed of a luminescent material (e.g. a vinyl material) and applied to the outside surface of the inner wall 32. In an alternative embodiment, the luminescent means 40 is incorporated in the composition of the wall structure of the main body 12, such as in a powder form which is mixed with the wall material composition during the molding process. In this embodiment, the luminescent material composition may be incorporated within the inner wall 32 and/or the outer wall 30. Moreover, the luminescent material may be incorporated within portions of the inner or outer wall, or throughout the entire composition of the inner or outer walls 32, 30.

Figure 4:
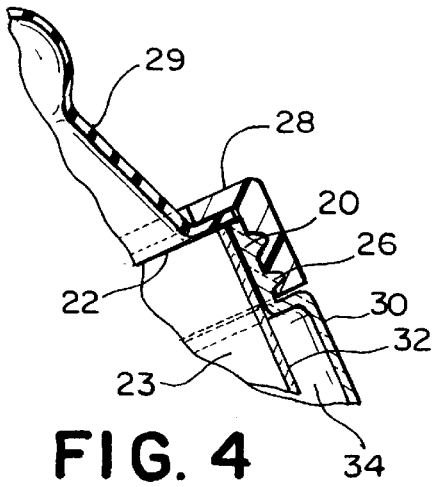
FIG. 4 is an isolated view, shown in cross-section, taken from the area indicated as 4 in FIG. 2, illustrating sealed attachment of the inner wall to the outer wall at the neck of the bottle and a conventional nipple and collar threadably secured thereto.

As seen throughout FIGS. 1 and 4, the outer wall 30 is preferably formed of a transparent material. More specifically, the outer wall 30, as well as the inner wall 32, are preferably formed of a plastic composition, such as a poly carbon. IN the preferred embodiment, both the outer wall 30 and inner wall 32 are transparent, so that the luminescent decorative elements 42 and liquid contents are visible through the wall structure from an exterior of the bottle. It is noted, however, that the inner wall 32 and/or the outer wall 30 may be partially or fully formed of a translucent or opaque material incorporating the luminescent means.

As best illustrated in FIG. 2, in a preferred embodiment the upper portion is angled relative to the lower portion with the wall structure, including the outer wall 30 and inner wall 32 being formed to define a smooth curve from the bottom 16 to the neck 20 on the front half of the main body, defining a generally concave outer surface configuration. This smooth curve is particularly significant with respect to the structure of the inner wall 32. Specifically, the inner wall 32 serves as a liner for holding the liquid contents. The smooth curve extending from the bottom 16' of the inner wall to the top edge 21, as seen in FIG. 3, serves to direct fluid flow towards the open top 22 and into the hollow nipple 29 for release during feeding. Moreover, the angled orientation of the upper portion 18 relative to the lower portion 14 serves to promote movement of the fluid contents towards the nipple when a child is feeding from the bottle in either a horizontal position or an upright, seated position.

The lower portion 14 of the main body 12 is specifically structured and configured to allow for easy grasping by an infant or toddler when drinking from the bottle. Specifically, a mid-section 60 of the lower portion 14 is provided with a smaller outer dimension than a lower section 62 and upper section 64. In a preferred embodiment, the lower portion 14 has an hourglass configuration, tapering in outer dimension towards the mid-section 60 and flaring out at the lower section 62 and upper section 64. The hourglass configuration is achieved by curving the wall structure on the rear side of the bottle inwardly from an elbow 68, defining a juncture between the lower portion 14 and upper portion 18. The inward curvature of the all structure, on the rear side of the bottle, towards the mid-section is then flared outwardly from the mid-section 60 to the lower -section 62 near the bottom 16 of the bottle. In this manner, the rear side of the lower portion 14 has a generally outer convex configuration which, in combination with the smooth concave curve on the front of the bottle forms the hourglass configuration on the lower portion 14, as seen in FIGS. 2 and 3. The hourglass configuration further provides for an enlarged base at the bottom 16 which serves to stabilize the bottle when filled with liquid and placed in a standing position on a table or counter surface.

As seen in FIG. 3, the inner wall 32 and outer wall 30 may be formed as separate pieces in the molding process. During manufacturing, the inner liner wall 32 is inserted through the top open neck 20 and within the outer wall 30 which defines an outer casing of the bottle 10. Once the inner wall 32 is fully inserted, as seen in FIG. 2, the inner and outer walls 32, 30 are heat sealed at the juncture surrounding the inside of the neck 20, where the inner wall 32 and outer wall 30 meet, as seen in FIG. 4. While heat sealing the inner and outer walls is a preferred method of manufacture, it is recognized that other methods of sealing the inner wall to the outer wall are contemplated within the scope of the invention. Moreover, it is recognized that the method of manufacturing the bottle is not limited to that as described above. The double-walled insulative structure of the bottle may be manufactured according to other well known manufacturing methods which may be deemed to be more suitable at the time of manufacture of the bottle of the present invention.

While the instant invention has been shown and described in accordance with preferred and practical embodiments thereof, it is recognized that departures from the instant disclosure are contemplated within the spirit and scope of the present invention which, therefore, should not be limited except as set forth in the following claims as interpreted under the doctrine of equivalents.

What is claimed is:

1. A nursing bottle comprising:

a main body including a lower portion with a bottom end and an upper portion having an outer peripheral dimension;

a neck extending from said upper portion and surrounding an open top communicating with an interior of the nursing bottle, said neck including an outer annular surface having a circumference which is less than the outer peripheral dimension of said upper portion and said neck further including threads about the outer annular surface;

said main body comprising:

an insulated wall structure defined by a transparent outer wall, a transparent inner wall and a void between the outer and inner walls;

said wall structure provided with a luminescent material for illuminating the nursing bottle in dark or dim light conditions and including a plurality of decorative elements formed of said luminescent material and applied to a surface of said wall structure within said void; and said upper portion being angled relative to said lower portion to define a smooth curve in said wall structure extending from said bottom end to said neck.

2. The nursing bottle as recited in claim 1 wherein said lower portion includes a mid-section having an outer peripheral dimension which is less than said outer peripheral dimension of said upper portion, and said outer peripheral dimension of said mid-section of said lower portion being sized and configured to allow for easy grasping by an infant.

3. The nursing bottle as recited in claim 1 wherein said lower portion of said main body includes an hourglass configuration which is structured and configured to allow for easy grasping by an infant while feeding from the nursing bottle.

4. The nursing bottle as recited in claim 1 wherein said angled upper portion and said smooth curve are structured and disposed to direct flow of fluid contents within an interior of the nursing bottle towards said open top when a child is feeding from the bottle in either a horizontal position or upright, seated position.

5. A nursing bottle for use with a nipple having a threaded collar, said nursing bottle comprising:

a main body including a lower portion with a bottom end, and an upper portion;

a neck extending from said upper portion and surrounding an open top communicating with an interior of the nursing bottle, said neck including threads about an outer annular surface for removably attaching the threaded collar and nipple onto said neck and in fluid communication with said open top;

said main body comprising:

an insulated wall structure defined by a transparent outer wall, an inner wall and a void between the outer and inner walls; and a luminescent material on said main body for illuminating the nursing bottle in dark or dim light conditions and including a plurality of decorative elements formed of said luminescent material and applied to said wall structure within said void.

6. The nursing bottle as recited in claim 5 wherein said upper portion is angled relative to said lower portion to define a smooth curve in said wall structure extending from said bottom end to said neck.

7. The nursing bottle as recited in claim 6 wherein said angled upper portion and said smooth curve are structured and disposed to direct flow of fluid contents within the interior of the nursing bottle towards said open top and said attached nipple when a child is feeding from the nursing bottle in either a horizontal position or an upright, seated position.

8. A nursing bottle for use with a nipple having a threaded collar, said nursing bottle comprising:

a main body having an integral one-piece structure and including a lower portion with a bottom end, an upper portion, and an interior;

a neck extending from said upper portion and surrounding an open top communicating with said interior of the nursing bottle, said neck including an outer annular surface with threads formed thereon for removably attaching the threaded collar and nipple onto said neck and in fluid communication with said open top and said interior;

said main body comprising:

an insulated wall structure defined by an outer wall, an inner wall and a void between said outer wall and said inner wall, and said outer wall and said inner wall being integrally joined at said upper portion to seal said empty void; and a plurality of decorative elements formed of a luminescent material and applied to a surface of said insulated wall structure within said void.

9. The nursing bottle as recited in claim 8 wherein said upper portion and said lower portion of said main body surround said interior and further wherein said upper portion and said lower portion include said insulated wall structure.

10. The nursing bottle as recited in claim 9 wherein said upper portion is angled relative to said lower portion.

11. The nursing bottle as recited in claim 9 wherein said upper portion is angled relative to said lower portion to define a smooth curve in said wall structure extending from said bottom end to said neck.

12. A nursing bottle for use with a nipple having a threaded collar, said nursing bottle comprising:

a main body having an integral one-piece structure and including a lower portion with a bottom end, an upper portion, and an interior;

a neck extending from said upper portion and surrounding an open top communicating with said interior of the nursing bottle, said neck including an outer annular surface with threads formed thereon for removably attaching the threaded collar and nipple onto said neck and in fluid communication with said open top and said interior;

said main body comprising:

an insulated wall structure defined by an outer wall, an inner wall and a void between said outer wall and said inner wall, and said outer wall and said inner wall being integrally joined at said upper portion to seal said empty void; and a luminescent material on said main body for illuminating the nursing bottle in dark or dim light conditions and including a luminescent composition incorporated within said insulated wall structure.

13. The nursing bottle as recited in claim 12 wherein said upper portion and said lower portion of said main body surround said interior and further wherein said upper portion and said lower portion include said insulated wall structure.

14. The nursing bottle as recited in claim 13 wherein said upper portion is angled relative to said lower portion.

15. The nursing bottle as recited in claim 13 wherein said upper portion is angled relative to said lower portion to define a smooth curve in said wall structure extending from said bottom end to said neck.

* * * * *